US010677092B2

(12) United States Patent
Döbler et al.

(10) Patent No.: US 10,677,092 B2
(45) Date of Patent: Jun. 9, 2020

(54) INNER CASING COOLING PASSAGE FOR DOUBLE FLOW TURBINE

(71) Applicant: General Electric Company, Schenectady, NY (US)

(72) Inventors: Rolf Döbler, Schriesheim (DE); Paolo Capozzi, Nussbaumen (CH); Andrzej Konieczny, Ennetbaden (CH)

(73) Assignee: General Electric Company, Schenectady, NY (US)

( * ) Notice: Subject to any disclaimer, the term of this patent is extended or adjusted under 35 U.S.C. 154(b) by 40 days.

(21) Appl. No.: 16/171,525

(22) Filed: Oct. 26, 2018

(65) Prior Publication Data

US 2020/0131930 A1 Apr. 30, 2020

(51) Int. Cl.

| | |
|---|---|
| ***F01D 25/28*** | (2006.01) |
| ***F01D 25/12*** | (2006.01) |
| ***F01D 25/14*** | (2006.01) |
| ***F01D 25/00*** | (2006.01) |

(52) U.S. Cl.

CPC ..... *F01D 25/12* (2013.01); *F01D 25/005* (2013.01); *F01D 25/14* (2013.01); *F05D 2220/31* (2013.01); *F05D 2240/12* (2013.01); *F05D 2260/2322* (2013.01)

(58) Field of Classification Search

CPC ..... F01D 1/00; F01D 25/005; F01D 25/12; F01D 25/14; F01D 25/24; F01D 25/26; F01D 25/28; F05D 2220/31; F05D 2240/12; F05D 2300/132

See application file for complete search history.

(56) References Cited

U.S. PATENT DOCUMENTS 3,594,095 A * 7/1971 Trassel ..... F01D 3/02 415/60
3,773,431 A * 11/1973 Bellati ..... F01D 25/26 415/108
3,915,588 A * 10/1975 Brandstatter ..... F01D 25/26 415/100
4,029,432 A * 6/1977 Meylan ..... F01D 25/26 415/101
4,915,581 A * 4/1990 Groenendaal, Jr. ... F01D 25/007 248/901

(Continued)

FOREIGN PATENT DOCUMENTS

EP 2344730 B1 12/2012

*Primary Examiner* — Igor Kershteyn
(74) *Attorney, Agent, or Firm* — Hoffman Warnick LLC

(57) ABSTRACT

A turbomachine structure having a first inner casing including a first and second flowpath oriented in opposing axial directions to one another; a second inner casing surrounding the first inner casing and including a third and fourth flowpath, wherein the third flowpath is fluidly connected to the first flowpath and the fourth flowpath is fluidly connected to the second flowpath; an extraction chamber defined between the first and second inner casings; a cooling passage defined between the first and second inner casings; a first extraction port fluidly connected to the cooling passage and to the first flowpath at a location in the first flowpath having a first pressure; and a second extraction port fluidly connected to the extraction chamber and to the second flowpath at a location in the second flowpath having a second pressure less than the first pressure.

20 Claims, 6 Drawing Sheets

(56) References Cited

U.S. PATENT DOCUMENTS

| | | | | |
|---|---|---|---|---|
| 5,149,247 | A * | 9/1992 | Gros | F01D 25/26 415/108 |
| 6,241,465 | B1 * | 6/2001 | Ulma | F01D 9/065 415/112 |
| 9,243,516 | B2 * | 1/2016 | Roge | F01D 25/28 |
| 2006/0292003 | A1 * | 12/2006 | Kriz | F01D 25/243 415/213.1 |
| 2011/0280720 | A1 | 11/2011 | Dallinger et al. | |
| 2017/0067368 | A1 * | 3/2017 | Malaguti Larrazabal | F01D 25/265 |

* cited by examiner

INNER CASING COOLING PASSAGE FOR DOUBLE FLOW TURBINE

BACKGROUND

Technical Field

The present disclosure relates to steam turbomachines, or more particularly, to cooling structures for inner casing components of turbomachines.

Related Art

Some power plant systems, for example nuclear, simple cycle, and combined cycle power plant systems, employ turbines (also referred to as turbomachines) in their design and operation. Some of these turbomachines employ airfoils (e.g., stationary or moveable turbine blades) which are exposed to working fluid flows during operation. These airfoils are configured to aerodynamically interact with the working fluid flows and convert energy (e.g., creating thrust, turning kinetic energy to mechanical energy, thermal energy to mechanical energy, etc.) from these working fluid flows. Typically, the working fluid flow is confined and directed within the turbomachine by a casing which encloses the airfoils and defines a flow path for the working fluid from an inlet to an outlet. In some designs, it is advantageous to divide the working fluid flow within the turbomachine between two opposing flow paths to interact with two sets of airfoils.

The efficiency of turbomachines is often related to the temperature at which the working fluid is admitted to the turbomachine. Principles of thermodynamics which are well-known to those skilled in the art dictate that higher efficiencies can be achieved by admitting the working fluid at the highest practical inlet temperature and exhausting it at the lowest practical temperature. Providing working fluids at a higher inlet temperature typically results in higher overall efficiencies. One factor which can limit the inlet temperature is the composition of components which are exposed to the working fluid. High temperature working fluids can damage the surfaces of components, including airfoils and casings, reducing efficiency and lifetime. Various design features are known in the art to protect turbomachine components from thermal damage. For example, components may be fabricated from materials which are resistant to high temperatures, such as nickel-based alloys. Another possible design feature is to provide one or more cooling fluid flow paths to remove heat from components exposed to high temperature fluids. A third design feature to protect components from thermal damage is including structures to minimize temperature differentials within a component. Multiple thermal protection design features may be incorporated in the same turbomachine. For example, components may include a heat-resistant material and also be provided with a cooling fluid flow. Since extracting working fluid to provide a cooling fluid flow reduces overall efficiency, it is desirable to extract as little working fluid as possible for cooling purposes and to recover as much of the energy remaining in the cooling fluid after it has performed the cooling function.

Because heat resistant materials are often significantly more costly than conventional materials, minimizing the amount used in a turbomachine may be a goal. Due to fluid typically cooling as it flows through a turbomachine, portions of the casing near the fluid inlet may require greater thermal protection than portions of the casing near the outlet. Additionally, a portion of the working fluid that has partially cooled while flowing though the turbomachine may be extracted to provide a cooling fluid flow to components closer to the inlet. To minimize costs while allowing higher working fluid inlet temperatures, the casing may be divided into two subunits. The subunit near the working fluid inlet may be fabricated from heat resistant materials and provided with a cooling fluid flow, while the other subunit is fabricated from less expensive materials with a lower heat resistance. When a high-temperature component is encased by or near materials with a lower heat resistance, excessive heat transfer from the high-temperature component can occur. Heat may be transferred by conduction, convection, or radiation. Providing thermal isolation between these components can reduce heat transfer and protect the component with lower heat resistance.

SUMMARY

A first aspect of the disclosure is directed to a turbomachine structure, including: a first inner casing including an inlet for a working fluid, a first flowpath segment, a second flowpath segment, a first axial end, and a second axial end, wherein the first flowpath segment and the second flowpath segment are oriented in opposing axial directions to one another, wherein the inlet is fluidly connected to both the first flowpath segment and the second flowpath segment, wherein the first flowpath segment exits through the first axial end, and wherein the second flowpath segment exits through the second axial end; a second inner casing surrounding the first inner casing, the second inner casing including a third flowpath segment and a fourth flowpath segment, wherein the third flowpath segment is fluidly connected to the first flowpath segment and the fourth flowpath segment is fluidly connected to the second flowpath segment; an extraction chamber defined between the first inner casing and the second inner casing adjacent the second axial end; a cooling passage defined between the first inner casing and the second inner casing and extending from the first axial end to the extraction chamber; a first extraction port positioned proximate to the first axial end and fluidly connected to the cooling passage and to the first flowpath segment at a location in the first flowpath segment having a first pressure; and a second extraction port positioned proximate to the second axial end and fluidly connected to the extraction chamber and to the second flowpath segment at a location in the second flowpath segment having a second pressure, wherein the second pressure is less than the first pressure.

A second aspect of the disclosure is directed to a turbomachine, including: a rotor configured to rotate around a rotation axis; a plurality of blades connected to the rotor; an inner casing enclosing the rotor, the inner case including: a first inner casing including an inlet for a working fluid, a first flowpath segment, a second flowpath segment, a first axial end, and a second axial end, wherein the first flowpath segment and the second flowpath segment are oriented in opposing axial directions to one another, wherein the inlet is fluidly connected to both the first flowpath segment and the second flowpath segment, wherein the first flowpath segment exits through the first axial end, and wherein the second flowpath segment exits through the second axial end; a second inner casing surrounding the first inner casing, the second inner casing including a third flowpath segment and a fourth flowpath segment, wherein the third flowpath segment is fluidly connected to the first flowpath segment and the fourth flowpath segment is fluidly connected to the second flowpath segment; an extraction chamber defined between the first inner casing and the second inner casing adjacent the second axial end; a cooling passage defined between the first inner casing and the second inner casing and extending from the first axial end to the extraction chamber; a first extraction port positioned proximate to the first axial end and fluidly connected to the cooling passage and to the first flowpath segment at a location in the first flowpath segment having a first pressure; and a second extraction port positioned proximate to the second axial end and fluidly connected to the extraction chamber and to the second flowpath segment at a location in the second flowpath segment having a second pressure, wherein the second pressure is less than the first pressure; and an outer casing enclosing the inner casing.

A third aspect of the disclosure is directed to a turbomachine system, including: a rotor configured to rotate around a rotation axis; a plurality of blades connected to the rotor; an inner casing enclosing the rotor, the inner casing including: a first inner casing including an inlet for a working fluid, a first flowpath segment, a second flowpath segment, a first axial end, and a second axial end, wherein the first flowpath segment and the second flowpath segment are oriented in opposing axial directions to one another, wherein the inlet is fluidly connected to both the first flowpath segment and the second flowpath segment, wherein the first flowpath segment exits through the first axial end, and wherein the second flowpath segment exits through the second axial end; a second inner casing surrounding the first inner casing, the second inner casing including a third flowpath segment and a fourth flowpath segment, wherein the third flowpath segment is fluidly connected to the first flowpath segment and the fourth flowpath segment is fluidly connected to the second flowpath segment; a cooling passage defined between the first inner casing and the second inner casing and extending from the first axial end towards the second axial end; a first extraction port positioned proximate to the first axial end and fluidly connected to the cooling passage and to the first flowpath segment at a location in the first flowpath segment having a first pressure; and an injection port positioned proximate to the second axial end and fluidly connected to the cooling passage and to the second flowpath segment at a location in the second flowpath segment having a second pressure, wherein the second pressure is less than the first pressure; and an outer casing enclosing the inner casing.

The foregoing and other features of the disclosure will be apparent from the following more particular description of embodiments of the disclosure.

BRIEF DESCRIPTION OF THE DRAWINGS

The embodiments of this disclosure will be described in detail, with reference to the following figures. In the drawings, like numbering represents like elements between the drawings.

Figure 1:
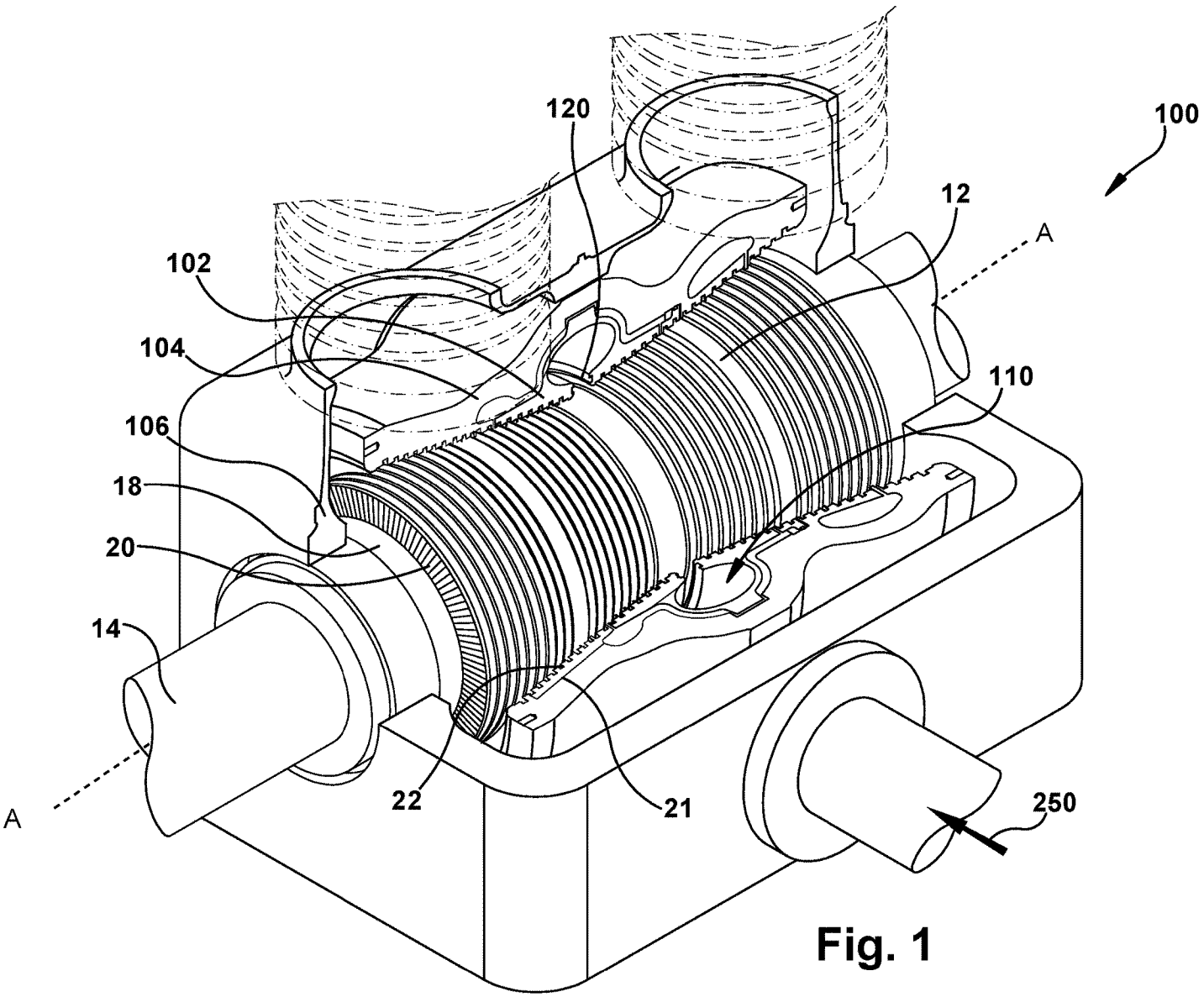
FIG. 1 shows a perspective partial cut-away perspective view of a portion of a turbomachine according to an embodiment of the present disclosure.

It is noted that the drawings of the disclosure are not to scale. The drawings are intended to depict only typical aspects of the disclosure, and therefore should not be considered as limiting the scope of the disclosure. Further, left and right sides in the drawings are not significant and may be exchanged in different embodiments.

DETAILED DESCRIPTION

In the following description, reference is made to the accompanying drawings that form a part thereof, and in which is shown by way of illustration specific representative embodiments in which the present teachings may be practiced. These embodiments are described in sufficient detail to enable those skilled in the art to practice the present teachings and it is to be understood that other embodiments may be used and that changes may be made without departing from the scope of the present teachings. The following description is, therefore, merely illustrative.

As used herein, the terms "axial" and/or "axially" refer to the relative position/direction of objects along axis A, which is substantially parallel to the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference which surrounds axis A but does not intersect the axis A at any location. Further, the term leading edge refers to surfaces which are oriented predominately upstream relative to the fluid flow of the system, and the term trailing edge refers to surfaces which are oriented predominately downstream relative to the fluid flow of the system.

Referring to the drawings, FIG. 1 shows a perspective partial cut-away illustration of a turbomachine 100 (e.g., a steam turbine) according to various embodiments of the invention. Turbomachine 100 includes a rotor 12 that includes a rotating shaft 14 and a plurality of axially spaced rotor wheels 18. A plurality of rotating blades 20 are mechanically coupled to each rotor wheel 18. More specifically, blades 20 are arranged in rows that extend circumferentially surround each rotor wheel 18. Embodiments of rotor 12 include integral rotors, e.g. monoblock or drum type, or rotors assembled from a plurality of subcomponents, e.g. keyed blade, shrink-on disc, or welded disc type. A static nozzle section 21 is shown including a plurality of stationary nozzles 22 that circumferentially surround rotor 12, configured such that nozzles 22 are axially positioned between adjacent rows of blades 20. Each circumferential row of blades 20 defines a turbine stage. Stationary nozzles 22 cooperate with blades 20 to form one or more stages of turbomachine 100, and to define a portion of a flow path through turbomachine 100. As shown, static nozzle section 21 at least partially surrounds rotor 12 (shown in this cut-away view).

It is understood that turbomachine 100 shown is a dual-flow turbine that includes an axially centered inlet 120 which feeds two sets of turbine stages. A first inner casing 102 surrounds an axially centered portion of rotor 12 including one or more turbine stages. First inner casing 102 may include one or more static nozzle sections 21. A second inner casing 104 surrounds first inner casing 102 and the remaining portion of rotor 12 includes one or more turbine stages. Second inner casing 104 may include one or more static nozzle sections 21. Outer casing 106 surrounds both first inner casing 102 and second inner casing 104, including all turbine stages within the inner casings. First inner casing 102, second inner casing 104, and outer casing 106 may each include two or more separate portions coupled together.

It is understood that the various teachings can be applied to axial turbomachines, e.g., axial inlet turbines that inlet a working fluid 250 from a first axial end and exhaust working fluid 250 from a second axial end after the working fluid has performed mechanical work on the turbine. The working fluid 250 may include a gas such as combustion gases, compressed air, or steam.

Returning to FIG. 1, in operation, working fluid 250 enters an inlet 120 of turbomachine 100 and is channeled through stationary nozzles 22. Nozzles 22 direct working fluid 250 against blades 20. Working fluid 250 passes through the stages imparting a force on blades 20 causing rotor 12 to rotate. At least one end of shaft 14 may extend axially away from turbomachine 100 and may be attached to a load or machinery (not shown) such as, but not limited to, a generator, and/or another turbomachine.

In some embodiments, turbomachine 100 may include multiple stages. For example, FIG. 1 shows sixteen stages on each side. It is to be understood that sixteen stages are shown as one example only, and each turbine may have more or less than sixteen stages. Generally, the temperature and pressure of the working fluid decreases at each stage as the working fluid expands through each stage in turn. Also, as will be described herein, the teachings of the disclosure do not require a multiple stage turbine.

Figure 2:
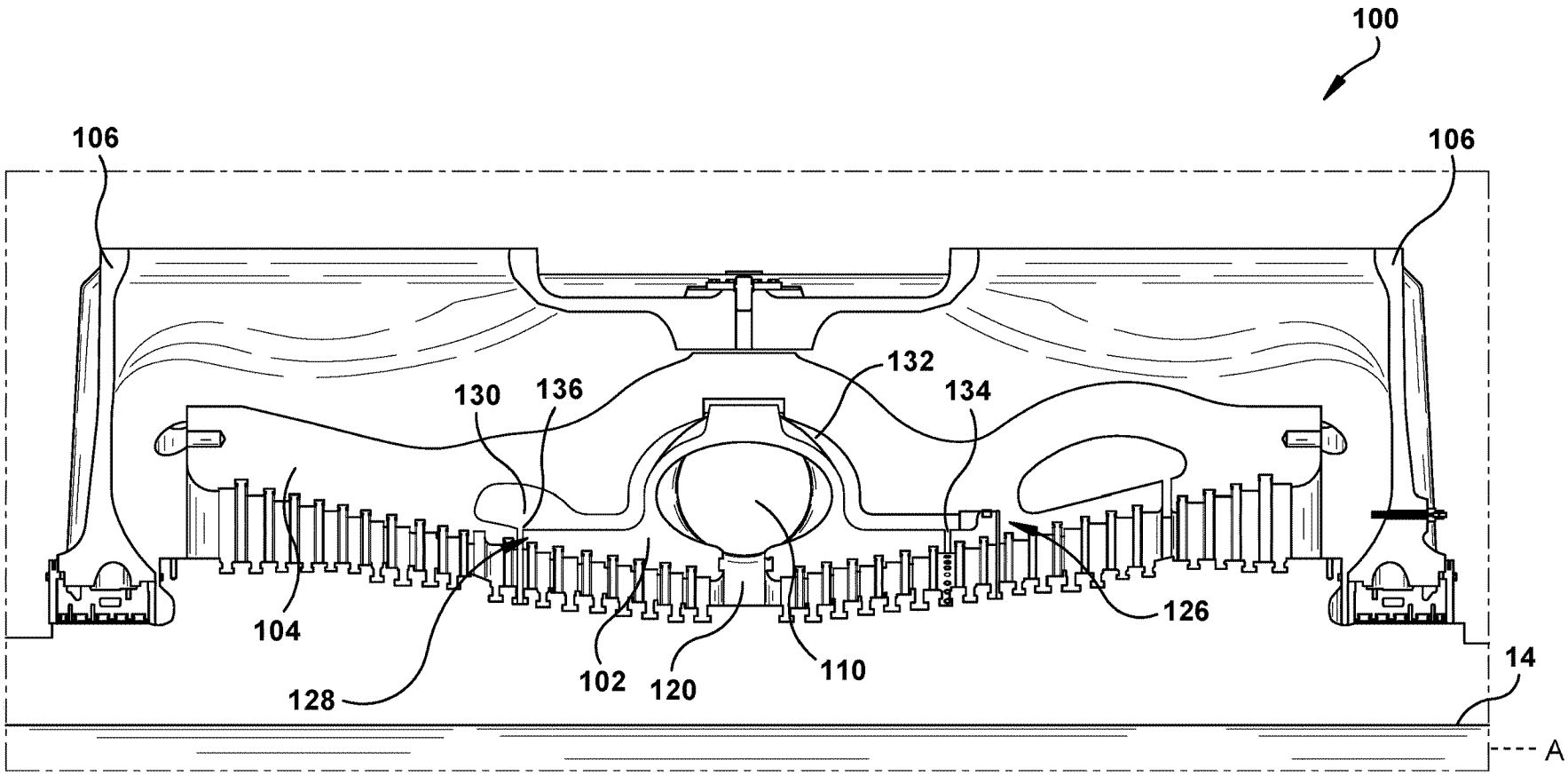
FIG. 2 shows a cross section of a portion of a turbomachine including an inner casing structure according to various embodiments of the present disclosure.
Figure 3:
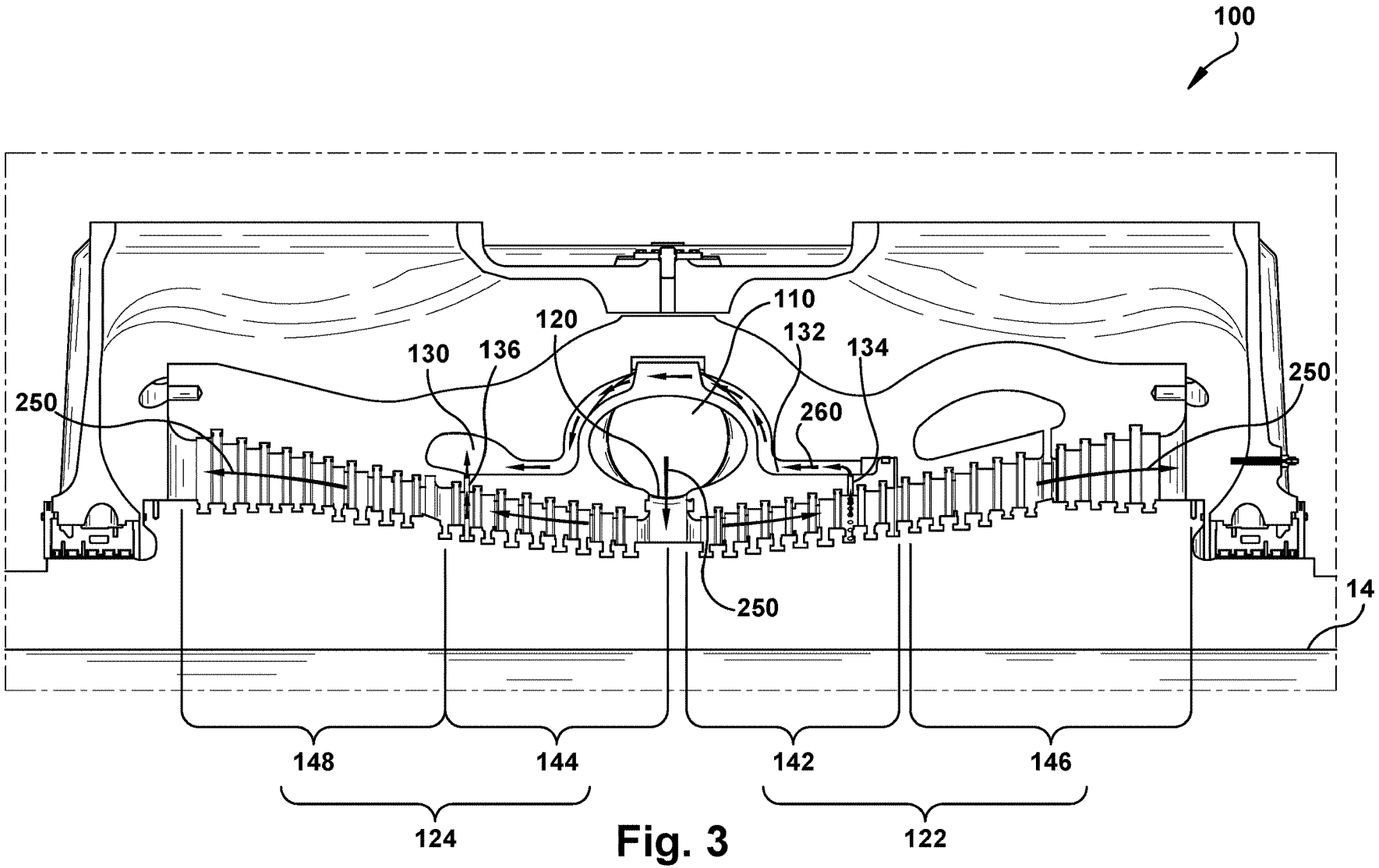
FIG. 3 shows a cross section of a portion of a turbomachine including fluid flow paths according to various embodiments of the present disclosure.

FIG. 2 shows a cross section of a portion of an example turbomachine 100 including an inner casing structure according to various embodiments of the present disclosure. FIG. 3 shows the same cross section of a portion of turbomachine 100 indicating fluid flows during operation. For clarity, details of rotor 12, blades 20, and static nozzle sections 21, from FIG. 1, are not shown surrounding a shaft 14.

Considering FIG. 2 and FIG. 3 together, in one embodiment turbomachine 100 is a double-flow turbine. Rotor, including shaft 14, is enclosed within a series of casings 102, 104, 106. Inner casings 102, 104 define two opposing flowpaths 122, 124 extending in opposite axial directions from a central region. Each flowpath has a generally conical shape increasing in diameter away from the central region. Rotor 12 (FIG. 1) is positioned along the common axis of flowpaths 122, 124 and, along with static nozzle sections 21 (not shown), defines a series of turbine stages within each flowpath. During operation, a working fluid is admitted under pressure from supply manifold 110 through one or more inlets 120 into an axially central region between the two flowpaths. The working fluid then expands through the series of turbine stages positioned in each flowpath, performing mechanical work on the turbine. Supply manifold 110 may have any shape. Non-limiting examples of supply manifold shapes include cylinders, frustums, toroids, volutes, etc.

As discussed above, higher efficiencies can be achieved by admitting the working fluid at the highest practical inlet temperature. One factor which can limit the inlet temperature is the composition of casings which are exposed to the working fluid. High temperature working fluids can damage the inner surfaces of the casings, reducing efficiency and lifetime. As the working fluid cools as it expands through successive turbine stages, this problem is most severe for the portions of flowpaths 122, 124 nearest inlet 120.

As discussed above, including materials which are resistant to high temperatures in components which are exposed to working fluid can permit higher working fluid temperatures. An example of such a material is nickel-based alloys containing at least 50% nickel. The balance of the alloy may include one or more of: chromium, cobalt, molybdenum, tungsten, tantalum, niobium (columbium), aluminum, titanium, iron, manganese, carbon, silicon, boron, and/or zirconium. Another example of such a material is cobalt-based alloys containing at least 45% cobalt. The balance of the alloy may include one or more of: chromium, nickel, tungsten, tantalum, iridium, aluminum, titanium, and/or carbon. Materials such as nickel-based alloys that are resistant to high temperatures are typically more expensive than conventional materials such as steel. As a result, it is often desirable to use these high-cost materials only in portions of the turbomachine where operating temperatures require resistance to high temperatures. Accordingly, the flowpath of the working fluid may be divided into two or more successive segments. Because the working fluid cools while expanding through successive turbine stages, portions of the flowpath nearest inlet 120, such as first inner casing 102, may include temperature-resistant materials. Downstream portions of the flowpath, such as second inner casing 104 may be manufactured from less expensive materials that are not as resistant to high temperatures such as steel.

As discussed above, providing cooling to remove heat can also protect turbomachine components exposed to high temperature fluids from thermal stress. Cooling may be provided by directing a cooling fluid 260 to flow across or through a portion of a turbomachine component, such as first inner casing 102, and then exhausting the cooling fluid, along with absorbed heat, from the turbomachine. This cooling fluid flow may also act to equalize temperatures within first inner casing 102 and to partially thermally isolate first inner casing 102 from second inner casing 104. In particular, the cooling passage 132 may extend around the majority of the circumference of first inner casing 102, thereby reducing the contact area available for heat conduction between first inner casing 102 and second inner casing 104. Cooling fluid 260 flow may also reduce convective heat transfer across cooling passage 132.

It has been found that, because the working fluid cools while expanding through successive turbine stages, cooling fluid 260 may be conveniently obtained by extracting a portion of working fluid 250 from one or more turbine stages downstream from inlet 120. This has the advantage of reducing the complexity of fluid passages within the turbomachine and eliminating the need to have an external source of cooling fluid. However, the working fluid pressure also decreases while expanding through successive turbine stages. As a result, the extraction point must be placed at an intermediate location between the inlet and before the working fluid has completely expanded through all turbine stages. Extraction may occur at more than one point, in which case the cooling fluid will be induced to flow from regions of higher pressure towards regions of lower pressure.

Multiple thermal protection design features may be incorporated in the same turbomachine. For example, in accordance with embodiments of this disclosure, components may include a heat-resistant material, physical gaps, heat-resistant surface coatings, and also be provided with cooling.

Returning to FIG. 2 and FIG. 3 together, first inner casing 102 surrounds a central portion of rotor 12 and defines flowpath segments 142, 144 of flowpaths 122, 124. Flowpath segments 142, 144 extend in opposing directions from centrally located inlet 120. Inlet 120 is in fluid communication with supply manifold 110, providing a path for working fluid 250 to flow through inlet 120 during operation and continue through flowpath segments 142, 144. First flowpath segment 142 opens through first axial end 126 of first inner casing 102. Second flowpath segment 144 opens through second axial end 128 of first inner casing 102. First inner casing 102 may be, but need not be, symmetric about inlet 120. For example, first axial end 126 may be closer to inlet 120 than second axial end 128. First inner casing 102 may include materials which are resistant to high temperatures, for example nickel-based alloys.

Continuing to refer to FIG. 2 and FIG. 3 together, second inner casing 104 surrounds first inner casing 102 and surrounds and defines two additional flowpath segments 146, 148 of flowpaths 122, 124. Third flowpath segment 146 is in fluid communication with first flowpath segment 142, and fourth flowpath segment 148 is in fluid communication with second flowpath segment 144. Second inner casing 104 abuts both first axial end 126 and second axial end 128 of first inner casing 102. Third flowpath segment 146 and fourth flowpath segment 148 each extend the generally conical shape of the respective flowpath segments 142, 144, increasing in diameter away from the central region. Second inner casing 104 may include materials which are less resistant to high temperatures than materials included in first inner casing 102, for example various grades of steel.

Cooling fluid 260 may be obtained by extracting a portion of working fluid 250 from a location in first flowpath 122 from one or more turbine stages downstream from inlet 120. Cooling fluid may be extracted through one or more first extraction ports 134 and admitted into cooling passage 132. First extraction port 134 may be in the form, for example, of an opening through first inner casing 102, of a gap between first inner casing 102 and second inner casing 104, of a slot in first axial end 126, or of any other means of fluid communication. Working fluid 250 will have a first pressure at the entrance to first extraction port 134.

Cooling fluid 260 may then be routed around the outer face of first inner casing 102 through cooling passage 132 away from first axial end 126 towards second axial end 128. Cooling passage 132 may be defined by a space between first inner casing 102 and second inner casing 104, or alternatively may be one or more openings through first inner casing 102. Cooling passage 132 may surround all or part of first inner casing 102, inlet 120, and/or supply manifold 110. Cooling fluid 260 will absorb heat from first inner casing 102 which is then transported away from first inner casing 102 by fluid flow, thus cooling first inner casing 102. The fluid flow between first inner casing 102 and second inner casing 104 provides partial thermal isolation between first inner casing 102 and second inner casing 104. This partial isolation reduces heat transfer to second inner casing 104, particularly heat transfer by conductive or convective means. A second benefit is a more uniform temperature within first inner casing 102, reducing thermal stresses.

Cooling fluid 260 may then be admitted to extraction chamber 130 which may be located proximate to second axial end 128. Extraction chamber 130 may be defined by a space between first inner casing 102 and second inner casing 104, or alternatively may be a chamber within second inner casing 104. Cooling fluid 260 may then be exhausted to any receiving space having a lower pressure than first pressure at the entrance to first extraction port 134, including venting to the atmosphere. Alternatively, cooling fluid 260 may be routed to an external condenser, sent to an external heat recovery unit, exhausted to interior of outer casing 106, blended back into working fluid 250, or directed to any other desired destination.

In some embodiments, a second portion of working fluid 250 may be extracted through second extraction port 136 located at a point in second flowpath 124 where working fluid 250 has a second pressure less than the first pressure at first extraction port 134. Second extraction port 136 may be in fluid communication with extraction chamber 130 and/or cooling passage 132. Because the second pressure is lower than the first pressure, and both are less than the external pressure, both the cooling fluid 260 and the second portion of working fluid 250 will be induced to flow into extraction chamber 130 to be exhausted from turbomachine 100.

Figure 4A:
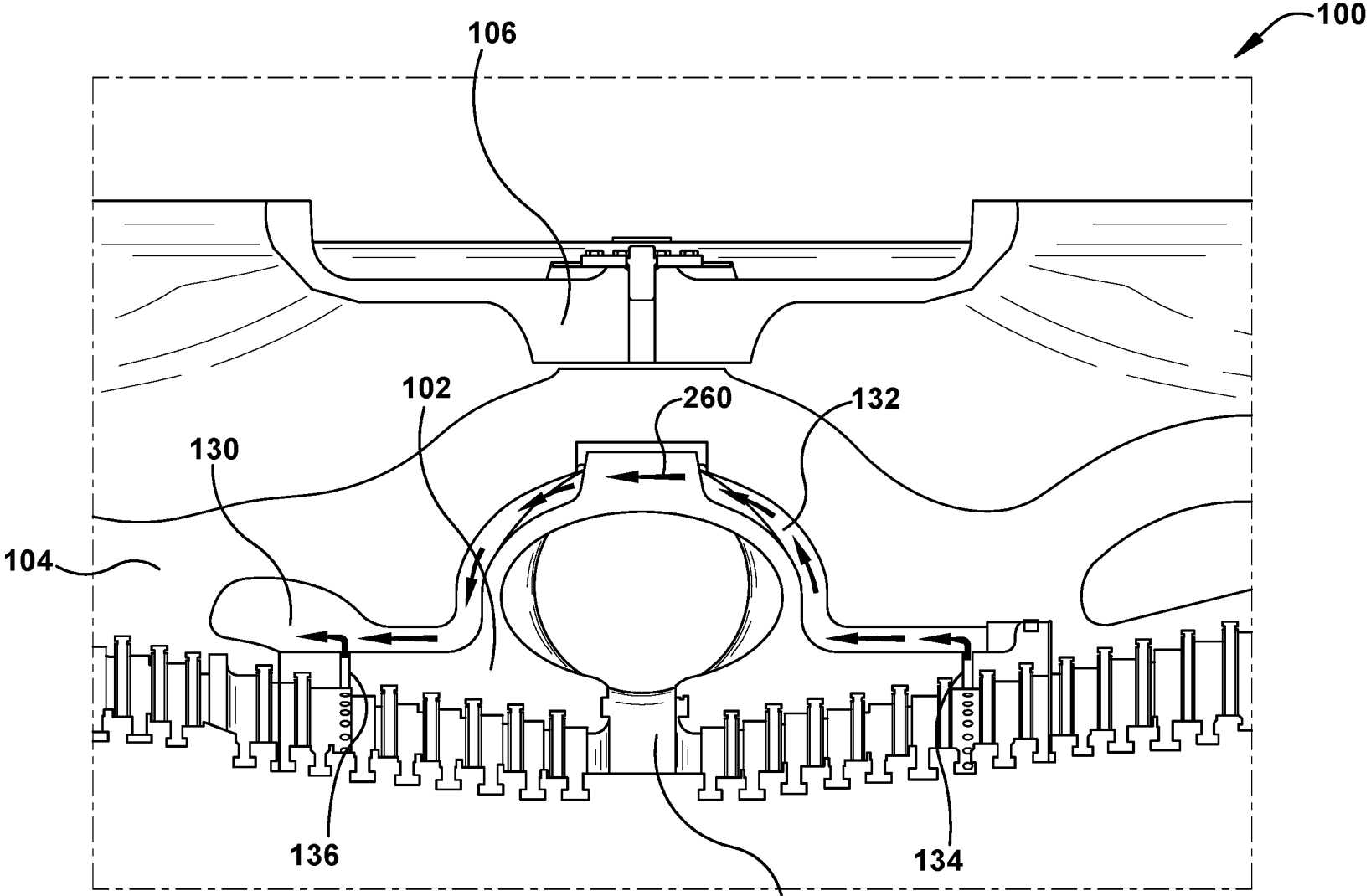
FIGS. 4A-4C show cross sections of a portion of a turbomachine including details of an inner casing structure according to three embodiments of the present disclosure.
Figure 4B:
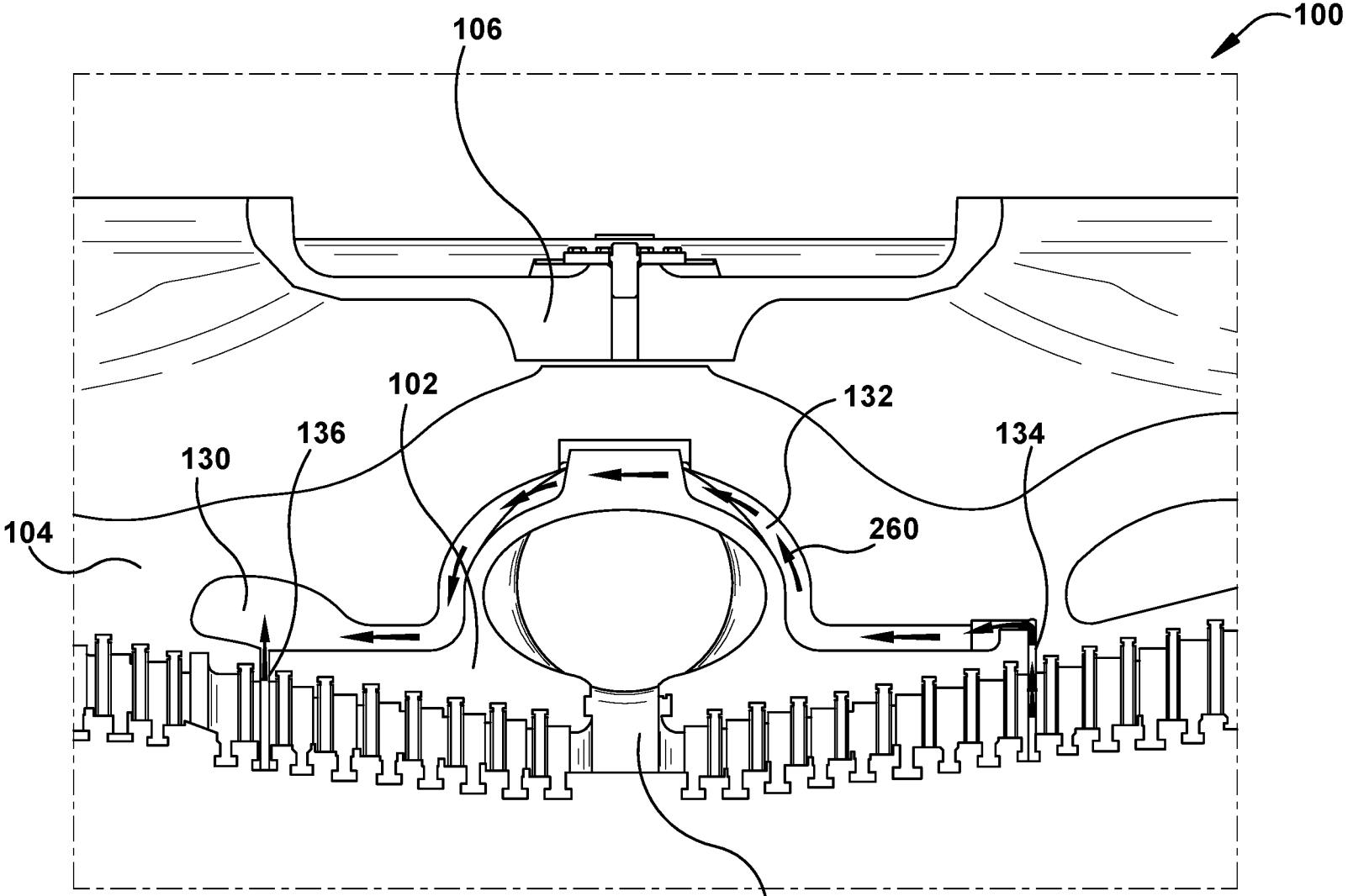
Figure 4C:
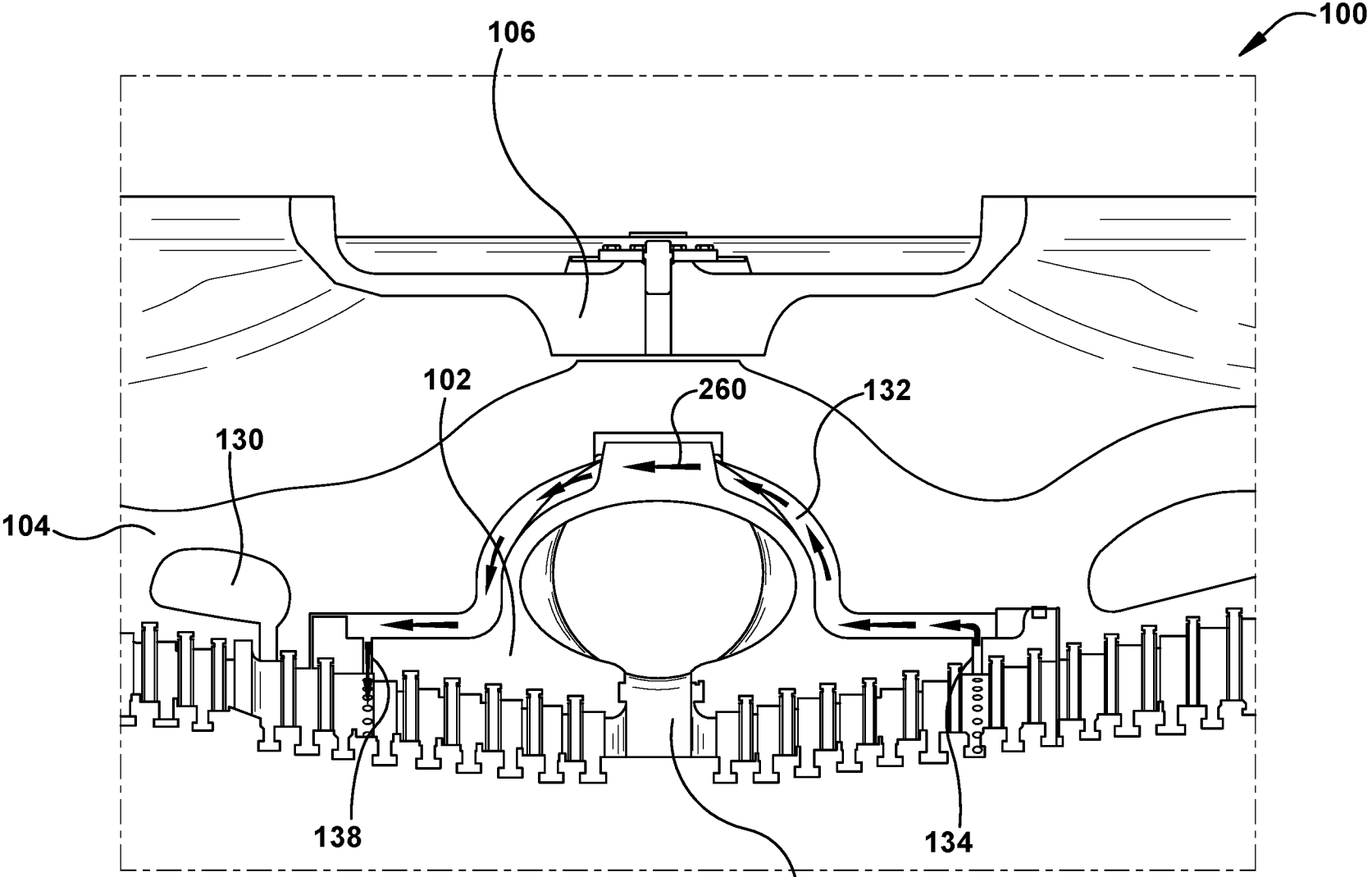

FIG. 2 and FIG. 3 illustrate an embodiment in which first extraction port 134 is an opening in first inner casing 102 and second extraction port 136 is a gap between first inner casing 102 and second inner casing 104. FIGS. 4A-C show cross sections of the central portion of turbomachine 100 including details of three alternative embodiments. FIG. 4A illustrates an embodiment in which both first extraction port 134 and second extraction port 136 are openings in first inner casing 102. FIG. 4B illustrates an embodiment in which both first extraction port 134 and second extraction port 136 are gaps between first inner casing 102 and second inner casing 104. FIG. 4C illustrates an embodiment in which cooling fluid 260 is blended back into working fluid 250 at injection port 138 without passing through extraction chamber 130. It should be understood that other arrangements for extraction ports 134, 136 may be employed without departing from the spirit of this disclosure. Various embodiments may include one, two, or more extraction ports provided a decreasing pressure gradient is preserved from first extraction port 134 to extraction chamber 130 or injection port 138.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s). "Substantially" refers to largely, for the most part, entirely specified or any slight deviation which provides the same technical benefits of the disclosure.

Unless otherwise noted, or as may be evident from the context of their usage, any terms, abbreviations, acronyms or scientific symbols and notations used herein are to be given their ordinary meaning in the technical discipline to which the invention most nearly pertains. The following terms, abbreviations and acronyms may be used throughout the descriptions presented herein and should generally be given the following meaning unless contradicted or elaborated upon by other descriptions set forth herein. Some of the terms set forth herein may be registered trademarks (®).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A turbomachine structure, comprising:

a first inner casing including an inlet for a working fluid, a first flowpath segment, a second flowpath segment, a first axial end, and a second axial end, wherein the first flowpath segment and the second flowpath segment are oriented in opposing axial directions to one another, wherein the inlet is fluidly connected to both the first flowpath segment and the second flowpath segment, wherein the first flowpath segment exits through the first axial end, and wherein the second flowpath segment exits through the second axial end;

a second inner casing surrounding the first inner casing, the second inner casing including a third flowpath segment and a fourth flowpath segment, wherein the third flowpath segment is fluidly connected to the first flowpath segment and the fourth flowpath segment is fluidly connected to the second flowpath segment;

an extraction chamber defined between the first inner casing and the second inner casing adjacent the second axial end;

a cooling passage defined between the first inner casing and the second inner casing and extending from the first axial end to the extraction chamber;

a first extraction port positioned proximate to the first axial end and fluidly connected to the cooling passage and to the first flowpath segment at a location in the first flowpath segment having a first pressure; and a second extraction port positioned proximate to the second axial end and fluidly connected to the extraction chamber and to the second flowpath segment at a location in the second flowpath segment having a second pressure, wherein the second pressure is less than the first pressure.

2. The turbomachine structure of claim 1, wherein the working fluid is steam.

3. The turbomachine structure of claim 1, wherein the first extraction port is defined between the first inner casing and the second inner casing.

4. The turbomachine structure of claim 1, wherein the first extraction port is positioned within the first inner casing.

5. The turbomachine structure of claim 1, wherein the second extraction port is defined between the first inner casing and the second inner casing.

6. The turbomachine structure of claim 1, wherein the second extraction port is positioned within the first inner casing.

7. The turbomachine structure of claim 1, wherein the first inner casing includes a first upper portion and a first lower portion coupled together, and wherein the second inner casing includes a second upper portion and a second lower portion coupled together.

8. The turbomachine structure of claim 1, wherein the first inner casing includes at least 50% nickel and the second inner casing includes less than 50% nickel.

9. The turbomachine structure of claim 1, wherein the first inner casing includes a material resistant to temperatures above 630° C.

10. A turbomachine, comprising:

a rotor configured to rotate around a rotation axis;

a plurality of blades connected to the rotor;

an inner casing enclosing the rotor, the inner casing including:

a first inner casing including an inlet for a working fluid, a first flowpath segment, a second flowpath segment, a first axial end, and a second axial end, wherein the first flowpath segment and the second flowpath segment are oriented in opposing axial directions to one another, wherein the inlet is fluidly connected to both the first flowpath segment and the second flowpath segment, wherein the first flowpath segment exits through the first axial end, and wherein the second flowpath segment exits through the second axial end;

a second inner casing surrounding the first inner casing, the second inner casing including a third flowpath segment and a fourth flowpath segment, wherein the third flowpath segment is fluidly connected to the first flowpath segment and the fourth flowpath segment is fluidly connected to the second flowpath segment;

an extraction chamber defined between the first inner casing and the second inner casing adjacent the second axial end;

a cooling passage defined between the first inner casing and the second inner casing and extending from the first axial end to the extraction chamber;

a first extraction port positioned proximate to the first axial end and fluidly connected to the cooling passage and to the first flowpath segment at a location in the first flowpath segment having a first pressure; and a second extraction port positioned proximate to the second axial end and fluidly connected to the extraction chamber and to the second flowpath segment at a location in the second flowpath segment having a second pressure, wherein the second pressure is less than the first pressure; and an outer casing enclosing the inner casing.

11. The turbomachine of claim 10, wherein the working fluid is steam.

12. The turbomachine of claim 10, wherein the first extraction port is defined between the first inner casing and the second inner casing.

13. The turbomachine of claim 10, wherein the first extraction port is positioned within the first inner casing.

14. The turbomachine of claim 10, wherein the second extraction port is defined between the first inner casing and the second inner casing.

15. The turbomachine of claim 10, wherein the second extraction port is positioned within the first inner casing.

16. A turbomachine, comprising:

a rotor configured to rotate around a rotation axis;

a plurality of blades connected to the rotor;

an inner casing enclosing the rotor, the inner casing including:

a first inner casing including an inlet for a working fluid, a first flowpath segment, a second flowpath segment, a first axial end, and a second axial end, wherein the first flowpath segment and the second flowpath segment are oriented in opposing axial directions to one another, wherein the inlet is fluidly connected to both the first flowpath segment and the second flowpath segment, wherein the first flowpath segment exits through the first axial end, and wherein the second flowpath segment exits through the second axial end;

a second inner casing surrounding the first inner casing, the second inner casing including a third flowpath segment and a fourth flowpath segment, wherein the third flowpath segment is fluidly connected to the first flowpath segment and the fourth flowpath segment is fluidly connected to the second flowpath segment;

a cooling passage defined between the first inner casing and the second inner casing and extending from the first axial end towards the second axial end;

a first extraction port positioned proximate to the first axial end and fluidly connected to the cooling passage and to the first flowpath segment at a location in the first flowpath segment having a first pressure; and an injection port positioned proximate to the second axial end and fluidly connected to the cooling passage and to the second flowpath segment at a location in the second flowpath segment having a second pressure, wherein the second pressure is less than the first pressure; and an outer casing enclosing the inner casing.

17. The turbomachine of claim 16, wherein the working fluid is steam.

18. The turbomachine of claim 16, wherein the first extraction port is defined between the first inner casing and the second inner casing.

19. The turbomachine of claim 16, wherein the first extraction port is positioned within the first inner casing.

20. The turbomachine of claim 16, wherein the first inner casing includes at least 50% nickel and the second inner casing includes less than 50% nickel.

* * * * *